United States Patent [19]

Ohashi

[11] 3,995,922

[45] Dec. 7, 1976

[54] PREFABRICATED REACH-IN REFRIGERATOR-FREEZER

[76] Inventor: Teruo Ohashi, 20, Ogi, Aizuwakamatsu, Japan

[22] Filed: July 7, 1975

[21] Appl. No.: 593,406

[30] Foreign Application Priority Data

July 10, 1975 Japan ..... 50-82014

[52] U.S. Cl. ..... 312/257 R; 312/236; 312/263

[51] Int. Cl.[2] ..... A47B 43/00; A47B 77/08

[58] Field of Search ..... 312/257 R, 263, 264, 312/236, 214; 62/442

[56] References Cited

UNITED STATES PATENTS

| | | | |
|---|---|---|---|
| 1,818,139 | 8/1931 | King | 62/442 |
| 1,954,148 | 4/1934 | Smith | 62/442 |
| 2,710,241 | 6/1955 | Lieberman | 312/257 R |
| 3,360,320 | 12/1967 | Lust | 312/257 R |
| 3,490,822 | 1/1970 | Gigante | 312/257 R |
| 3,604,774 | 9/1971 | Furman | 312/263 |
| 3,632,968 | 1/1972 | Wilson | 312/236 |
| 3,870,388 | 3/1975 | Lofgren | 312/264 |
| 3,895,215 | 7/1975 | Gordon | 312/236 |
| 3,911,248 | 10/1975 | Buday et al. | 312/236 |

*Primary Examiner*—Paul R. Gilliam
*Assistant Examiner*—Victor N. Sakran
*Attorney, Agent, or Firm*—Lawrence I. Field

[57] ABSTRACT

A prefabricated reach-in refrigerator-freezer which has a floor panel, a front panel with doors, right and left side panels, a back panel and a ceiling panel supporting a refrigerating unit. All the areas where the above panels come into contact with each other are connected and sealed with removable joints to enable easy assembly and disassembly.

9 Claims, 13 Drawing Figures

PREFABRICATED REACH-IN REFRIGERATOR-FREEZER

BACKGROUND OF THE INVENTION

This invention relates to a prefabricated reach-in refrigerator-freezer and more particularly to a prefabricated set for assembling a reach-in refrigerator-freezer, wherein various panels and refrigerating units are connected with removable joints or disconnected to enable easy assembly or disassembly and to allow the refrigerator-freezer capacity to be freely changed to suitably provide a required capacity alone.

Conventional refrigerator-freezers may be divided into two general types: one which is mass-produced with a given capacity and the other which has a refrigerating unit installed in a refrigerating compartment.

In the former case, a refrigerator-freezer of required capacity can be freely selected and purchased from among many ready-made refrigerator-freezers available in various capacities, but refrigerator-freezers of this type are assembled with their capacity uniformly determined at the manufacturing plant. Such refrigerator-freezers therefore have so much space to make their transportation and storage extremely inconvenient. Furthermore, when the available capacity of an existing refrigerator-freezer becomes less than required due to, for instance, business expansion, the inability to change the capacity of such a ready-made refrigerator-freezer requires another refrigerator-freezer to be purchased to make up the insufficient capacity or a larger-capacity refrigerator-freezer to be purchased to replace the existing refrigerator-freezer.

In the latter case, unlike a ready-made refrigerator-freezer, a refrigerating compartment of adequate capacity can be freely determined and installed but, when the available capacity becomes less than required, the refrigerating compartment must be rebuilt into a larger-capacity one.

In either case, the total inability to change the capacity of a refrigerator-freezer may be coped with by purchasing or installing a larger than required refrigerator-freezer, but such a method is uneconomical as when the available capacity becomes more than required. The above inconvenience may also occur when the available capacity becomes less than required. This problem is particularly serious for business-use refrigerator-freezers.

STATEMENT OF OBJECTS

In view of the above circumstances, the present invention has been made to eliminate various defects inherent in conventional art.

It is therefore an object of this invention to provide a prefabricated set for assembling a reach-in refrigerator-freezer which consists of various panels and removable joints for ease of assembly and disassembly and, consequently, for great convenience of transportation and storage.

It is another object of this invention to provide a novel prefabricated set for assembling a reach-in refrigerator-freezer, the capacity of which can be freely changed to suitably obtain the required capacity alone by connecting with removable joints or disconnecting the required number of panels and refrigerating units.

It is still another object of this invention to provide a novel prefabricated set for assembling a reach-in refrigerator-freezer wherein, when another refrigerator-freezer is added, the original and added refrigerator-freezers become common without any divisions so as to permit maximum utilization of the combined inside capacity.

The above and other objects of the present invention can be achieved by a prefabricated set for assembling a reach-in refrigerator-freezer which comprises a ceiling panel supporting a refrigerating unit, a floor panel, a front panel with doors, right and left side panels and a back panel, all the areas where respective panels come into contact with each other being connected and sealed with removable joints for ease of assembly or disassembly, the above floor panel and the required number of other floor panels, the above front panel and the required number of other front panels, the above back panel and the required number of other back panels and the above ceiling panel and the required number of other ceiling panels being connected with removable joints between the above right and left side panels or disconnected so as to enable the refrigerator-freezer capacity to be freely changed to suitably obtain a required capacity alone.

According to one aspect of the present invention, since members composing a refrigerator-freezer are prefabricated or unitized as individual units and can be connected with joints or disconnected so as to enable an amateur to readily assemble or disassemble, the refrigerator-freezer can be disassembled and carried through a narrow doorway without any trouble and can be transported in great quantities in disassembled form, thus providing large savings in transportation, storage and other expenses.

According to a further aspect of the invention, when the available capacity of an existing refrigerator-freezer becomes less than required due to, for instance, business expansion, the required number of panels and refrigerating units can be added by connecting with joints between the original right and left side panels so as to increase the refrigerator-freezer capacity. When the available capacity of an existing refrigerator-freezer becomes more than required, the required number of panels and refrigerating units can be disconnected at joints and removed from between the right and left side panels in the reverse procedure so as to readily reduce the refrigerator-freezer capacity to that required. Therefore, the required refrigerator-freezer capacity can be always obtained conveniently.

When part of a refrigerator-freezer is damaged, troubled or broken for some cause, the conventional refrigerator-freezer must be replaced with a new purchased one but the refrigerator-freezer of this invention only requires a new panel or unit to be purchased to replace the defective one.

When the refrigerator-freezer capacity is increased, the combined inside becomes common without any divisions so that the expanded capacity can be fully utilized. Failure of one refrigerating unit can be readily coped with by operating the other refrigerating units without prejudicing the role of the refrigerator-freezer, and in cold regions or seasons, only one or two refrigerating units need be operated to play the role of the refrigerator-freezer, thus resulting in electric power saving.

Unlike conventional reach-in refrigerator-freezers, no use of wooden posts helps reduce weight to approximately one-third of that of the conventional refrigerator-freezer and use of urethane foam insulation helps improve the heat-insulating effect.

A dew-proof heater installed to the frame of the front doors prevents condensate from depositing on the frame.

BRIEF DESCRIPTION OF THE DRAWINGS

The above and other objects and features of the present invention will become more apparent upon reading the following preferred embodiments thereof while referring to the accompanying drawings, in which.

DETAILED DESCRIPTION OF THE INVENTION IN RELATION TO THE DRAWINGS

Figure 1:
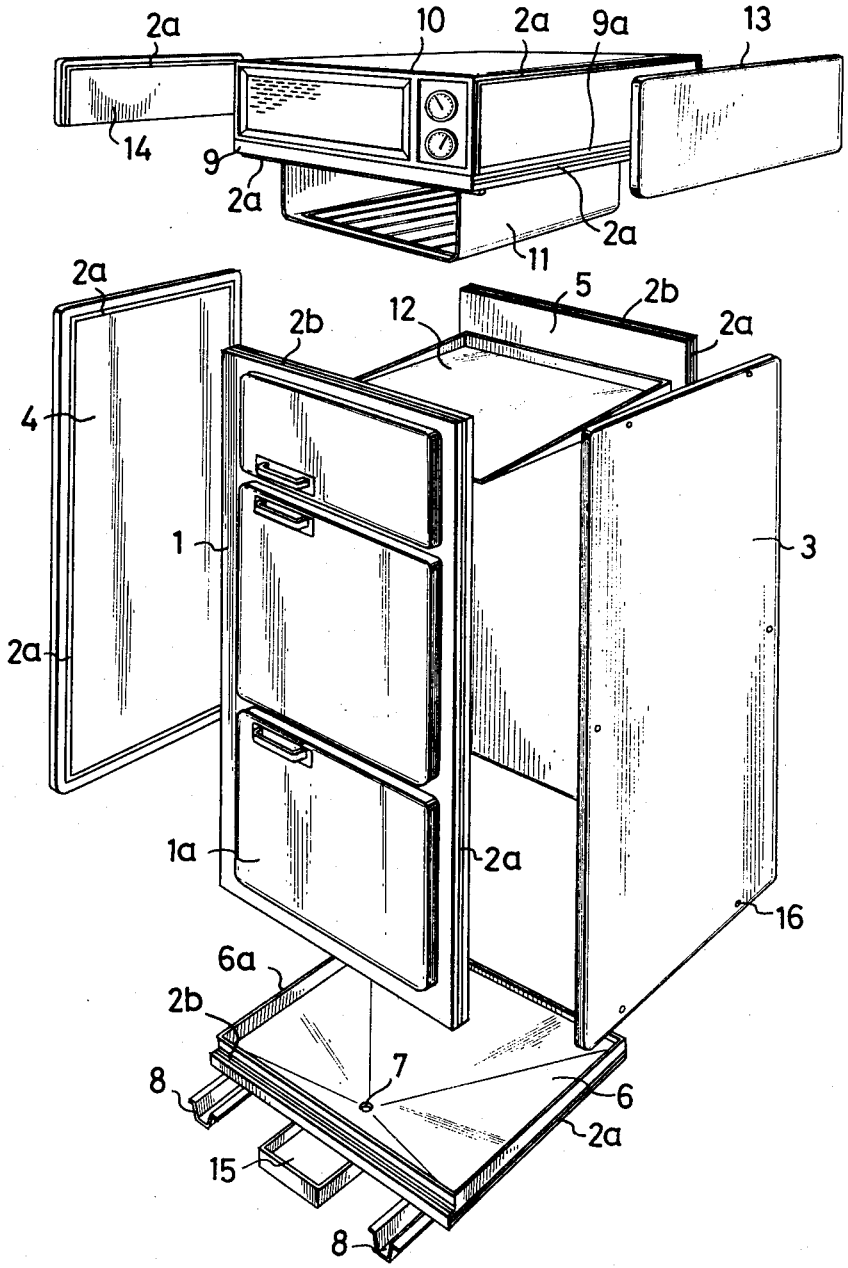
FIG. 1 is an exploded view in perspective of disassembled members according to a preferred embodiment of this invention.

Referring first to FIG. 1, there is shown a preferred embodiment of a refrigerator-freezer of the present invention with respective members thereof disassembled. In the drawing, the reference numeral 1 indicates a front panel, which is provided through hinges with the required number of doors 1*a*. The front panel 1 is also provided on the periphery with the projection 2*a* of a joint 2 suitable for interlocking with the joint recess of another panel and with a recess 2*b* suitable for interlocking with the joint projection of another panel. The reference numeral 3 indicates a right side panel, which is provided on the inside periphery with a joint recess 2*b* (not shown) suitable for interlocking with, for instance, the joint projection 2*a* of the front panel 1. The reference numeral 4 indicates a left side panel, which is provided on the inside periphery with a joint projection 2*a* suitable for interlocking with, for instance, the joint recess 2*b* of the front panel 1. The reference numeral 5 indicates a back panel, which is provided on the periphery with a joint projection 2*a* for interlocking with, for instance, the joint recess 2*b* of the right side panel 3 and with a recess 2*b* for interlocking with, for instance, the joint projection 2*a* of the left side panel 4. The reference numeral 6 indicates a floor panel, which is provided with joint recesses 2*b* and projections 2*a* suitable for interlocking with the corresponding joint projections 2*a* and recesses 2*b* of the above respective panels as well as with a drain hole 7 and legs 8. The reference numeral 9 indicates a ceiling panel, which is provided with joint recesses 2*b* and projections 2*a* suitable for interlocking with the corresponding joint projections 2*a* and recesses 2*b* of the above respective panels. The ceiling panel 9 is also provided with a machine compartment 10, which is equipped with a refrigerating unit, controls, instruments and other required units and apparatus. The reference numerals 11 and 12 indicate a cooling panel and a drip pan, respectively. The reference numeral 13 indicates the right side panel of the machine compartment 10, which is provided on the back with a joint recess 2*b*. The reference numeral 14 indicates the left side panel of the machine compartment 10, which is provided on the back with a joint projection 2*a*. The reference numeral 15 indicates a drain pan.

Figure 2:
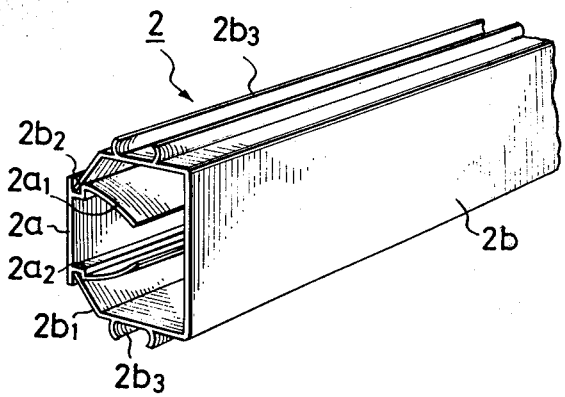
FIG. 2 is a perspective view showing an embodiment of a joint.
Figure 3A:
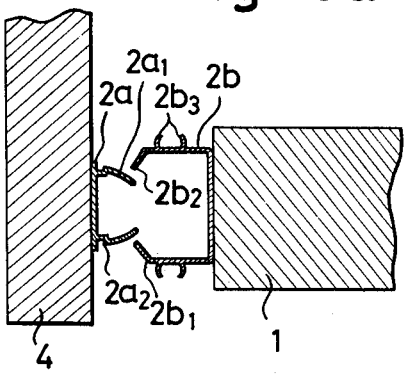
FIGS. 3*a* and 3*b* are partially enlarged sectional views of joints, FIG. 3*a* showing the pre-interlocking or disassembled state of a joint and FIG. 3*b* the interlocked state of a joint.
Figure 3B:
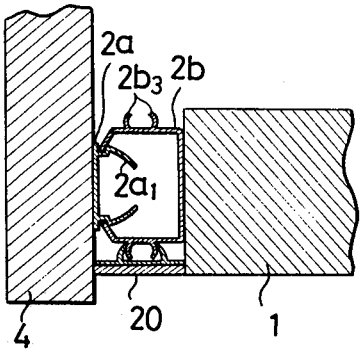
Figure 4:
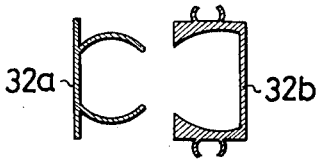
FIG. 4 is a sectional view showing another embodiment of a joint.

It is apparent from the above description that a refrigerator-freezer of the invention is unitized into various panels, that the projection 2*a* or recess 2*b* of the joint 2 as shown in FIGS. 2 and 3 is fixed at the connecting surface of one panel, and that the joint recess 2*b* or projection 2*a* is fixed at the connecting surface of the mating panel. The joint 2 has the corresponding portions $2b_1$ of the recess 2*b* formed in such a way that their distance becomes progressively narrowed outward, as shown in FIGS. 2 and 3. When the joint 2 is to be interlocked or when both projection and recess are pushed toward each other, the bent tips $2b_2$ of the portions $2b_1$ of the recess 2*b* move expandng along the outside surface of the inclined portions $2a_1$ of the projection 2*a* and the tips $2b_2$ of the recess 2*b* engage with the bent portions $2a_2$ of the projection 2*a*, thereby interlocking the projection 2*a* and the recess 2*b*. When interlocking both projection 2*a* and recess 2*b*, the portions $2b_1$ of the recess 2*b* are formed in such a way that their distance becomes progressively narrowed outward as described above so that the projection 2*a* and recess 2*b* can be tightly interlocked by the resillience of the portions $2b_1$. The joint recess 2*b* has projected rails $2b_3$ provided to install decorative boards. In addition to the above joints for connecting panels, the joint 32 (projection 32*a* and recess 32*b*) as shown in FIG. 4 and other suitable types of joint can be obviously used.

A refrigerator-freezer of the present invention can be readily assembled by interlocking the joint projection 2*a* with the corresponding joint recess 2*b* provided to respective panels as shown in FIGS. 2 and 3 and by fixing the joint with screws 16. Disassembly can also be readily accomplished in the reverse procedure.

Figure 5:
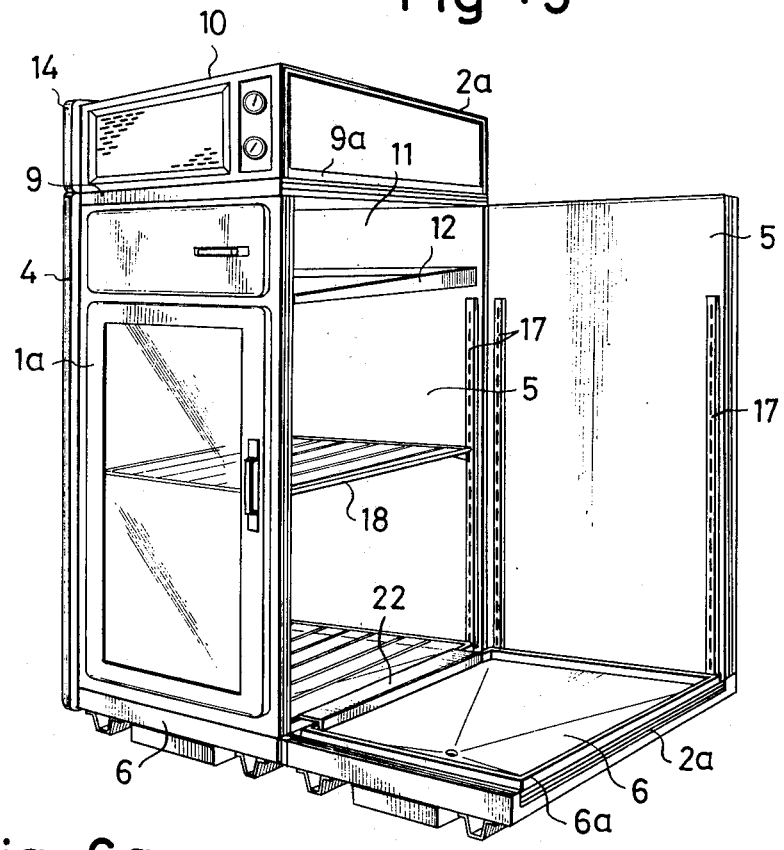
FIG. 5 is a perspective view showing the refrigerator-freezer capacity being added.
Figure 6A:
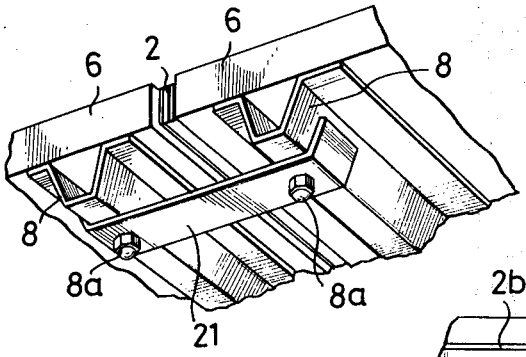
FIGS. 6*a* to 7*b* are views explaining the methods of connecting a plurality of floor panels.
Figure 6B:
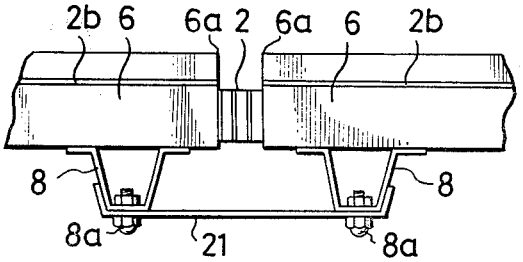
Figure 7A:
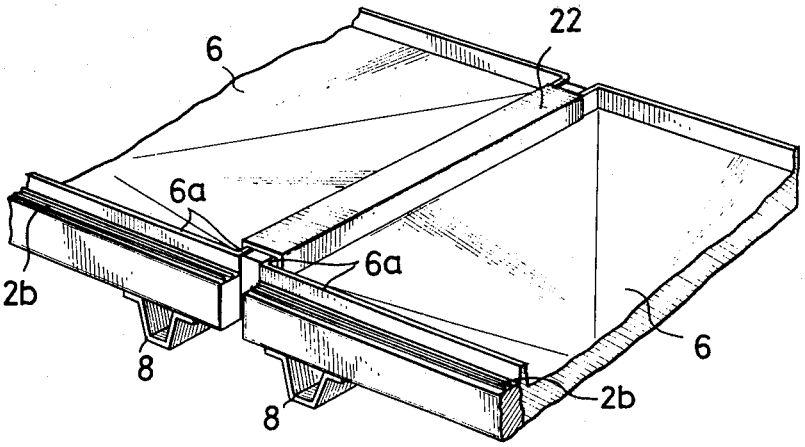
Figure 7B:
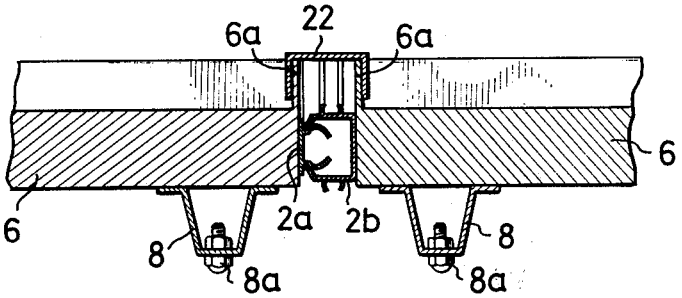
Figure 8:
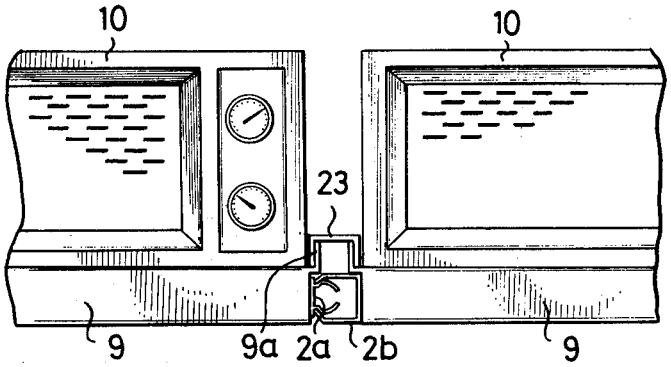
FIG. 8 is a view explaining the method of connecting a plurality of ceiling panels.

Referring now to FIG. 5, there is shown the capacity of a refrigerator-freezer of this invention being increased. The right side panel 3 and the right side panel 13 of the machine compartment 10 are temporarily removed. Another floor panel 6 is connected to the original floor panel 6 with the joint 2 and another back panel 5 to the original back panel 5 with the joint 2. Another front panel 1 and ceiling panel 9 are about to be connected with the joints 2. It should be noted that reinforcing members are used for connecting two or more identical panels. When two or more floor panels are to be connected, a strap member 21 is provided across the projections 8*a* of the adjacent legs 8 of the corresponding floor panels 6 as shown in FIGS. 6*a* and 6*b*, and a C-shaped member 22 is provided across the adjacent ears 6*a* of the corresponding floor panels 6 as shown in FIGS. 7*a* and 7*b*. When two or more ceiling panels are to be connected, a C-shaped channel member 23 is provided across the adjacent ears 9*a* of the corresponding ceiling panels 9.

After these panels have been connected, the right side panel 3 and the right side panel 13 of the machine compartment 10 are connected together with the joint 2 and, then, fixed with screws 16. In FIG. 5, the reference numerals 17, 18 and 12 indicate a shelf post, a shelf and a drip pan, respectively. Although there is shown a front panel 1 having a large and transparent right-hand door 1*a*, obviously doors used for front panels may be large-sized, transparent, right-hand, left-hand or any other suitable type.

Figure 9:
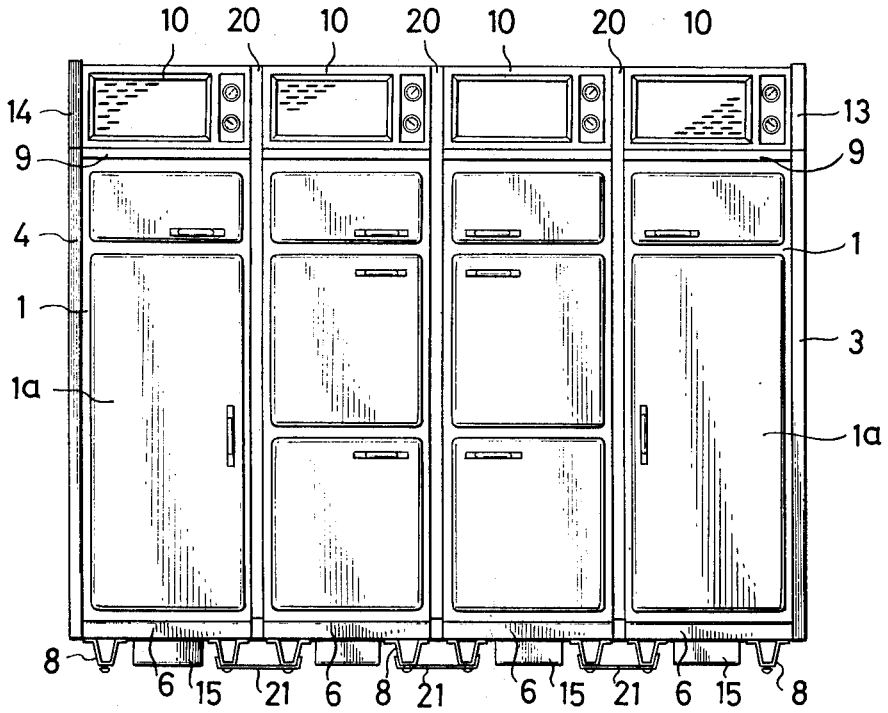
FIG. 9 is an elevation of four refrigerator-freezers connected together to increase the available capacity.

Referring to FIG. 9, there is shown an elevation of four refrigerator-freezers of the present invention connected together. Four front panels 1, four back panels 5, four floor panels 6 and four ceiling panels 9 are connected with joints 2 between the right and left side panels 3 and 4, providing the common inside without any divisions. All the areas between the front panels 1, the front panel 1 and the left side panel 4, the front panel 1 and the right side panel 3, the ceiling panels 9, the ceiling panel 9 and the left side panel 14 of the machine compartment 10, the ceiling panel 9 and the right side panel 13 of the machine compartment 10 and any other area where the joint 2 is exposed outside are covered with decorative boards 20 engaged on the projected rails $2b_3$ of the recess 2*b* as shown in FIG. 3.

Figure 10:
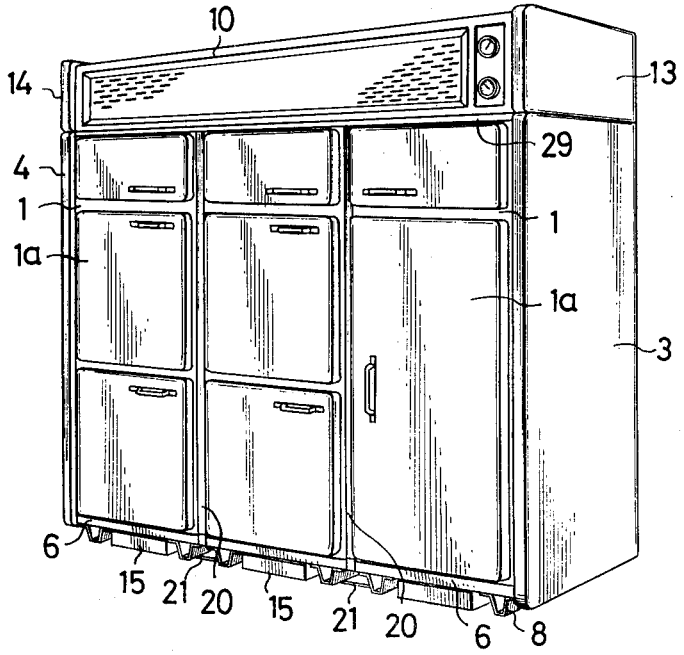
FIG. 10 is a perspective view of three refrigerator-freezers connected together.

Although one refrigerating unit is used for one front panel (ceiling panel) in FIG. 9, one ceiling panel 29 which is equipped with a larger refrigerating unit and which can accommodate two or three front panels may also be used as shown in FIG. 10 when it is apparent in advance that two or three front panels will be used.

While the present invention has been described in its preferred embodiments shown in the accompanying drawings, these embodiments are illustrative only and obviously not restrictive. It is therefore to be understood that the present invention may be practiced with various changes and modifications without departing from the spirit and scope thereof within the scope of the appended claims.

We claim:

1. A prefabricated set for assembling a reach-in refrigerator-freezer comprising: a floor panel, a front panel with doors, right and left side panels, a back panel and a ceiling panel supporting a refrigerating unit, said respective panels being joined and assembled with connecting and sealing removable joints consisting of (1) a projection on one panel comprising two members, the distance between which at first becomes wider and then progressively narrows outward, and of (2) a recess on another panel consisting of two members the distance between which becomes progressively narrowed outward, said projection and recess being interlocked by resillience of the recess after insertion of said projection into said recess.

2. A prefabricated set for assembling a reach-in-refrigerator-freezer as claimed in claim 1, wherein there are provided the required number of other floor panels connecting with the original floor panel, the required number of other front panels with doors connecting with the original front panel with doors, the required number of other back panels connecting with the original back panel and the required number of other ceiling panels connecting with the original ceiling panel, all of said panels being joined and assembled with connecting and sealing removable joints consisting of a projection on one panel comprising two members, the distance between which at first becomes wider and then progressively narrowed outward and of a recess on another panel consisting of two members, the distance between which becoming progressively narrowed outward, said projection and recess being interlocked by resillience of the recess after insertion of said projection into said recess, so as to enable the refrigerator-freezer capacity composed of said panels to be freely changed to suitably obtain a required capacity.

3. A prefabricated set for assembling a reach-in refrigerator-freezer as claimed in claim 1, wherein said joint consists of a male projection comprising two members, the distance between which being at first parallel, then suddenly widening outward only to become progressively narrowed and of a female recess comprising two members, the distance between which becoming progressively narrowed outward and suddenly being restricted at the tips.

4. A prefabricated set for assembling a reach-in refrigerator-freezer as claimed in claim 1, wherein said joint consists of a circular projection, the section of which being hollowed out and of a recess, the section of which being C-shaped.

5. A prefabricated set for assembling a reach-in refrigerator-freezer as claimed in claim 1, wherein a decorative board is attached to the outside of the recess of said joint.

6. A prefabricated set for assembling a reach-in refrigerator-freezer as claimed in claim 2, wherein reinforcing strap members are attached to a plurality of said floor panels across the adjacent legs of corresponding floor panels.

7. A prefabricated set for assembling a reach-in refrigerator-freezer as claimed in claim 2, wherein reinforcing channel members are attached to a plurality of said floor panels across the adjacent ears of corresponding floor panels.

8. A prefabricated set for assembling a reach-in refrigerator-freezer as claimed in claim 2, wherein reinforcing C-shaped members are attached to a plurality of said ceiling panels across the adjacent ears of corresponding ceiling panels.

9. A prefabricated set for assembling a reach-in refrigerator-freezer, as claimed in claim 2, wherein a plurality of said ceiling panels are formed into one panel.

* * * * *